US008938888B1

(12) United States Patent
Brown

(10) Patent No.: US 8,938,888 B1
(45) Date of Patent: Jan. 27, 2015

(54) HAIR DRYING SYSTEM

(71) Applicant: Kevin E. Brown, Woodbridge, VA (US)

(72) Inventor: Kevin E. Brown, Woodbridge, VA (US)

( * ) Notice: Subject to any disclaimer, the term of this patent is extended or adjusted under 35 U.S.C. 154(b) by 192 days.

(21) Appl. No.: 13/715,745

(22) Filed: Dec. 14, 2012

(51) Int. Cl.
*A45D 20/00* (2006.01)

(52) U.S. Cl.
CPC ..... *A45D 20/00* (2013.01)
USPC . 34/90; 34/97; 132/212; 601/49; 297/180.14; D28/17; 392/384

(58) Field of Classification Search
USPC ..... 34/90, 96, 97, 98, 99, 100; 132/7, 9, 132/212; 601/21, 26, 49; 297/180.12, 297/180.14; D28/9, 10, 12, 17; 392/384, 392/385
See application file for complete search history.

(56) References Cited

U.S. PATENT DOCUMENTS

| | | | | | |
|---|---|---|---|---|---|
| 2,087,695 | A | * | 7/1937 | Miller | 52/32 |
| 2,150,720 | A | * | 3/1939 | Mullooly | 34/90 |
| 2,266,653 | A | * | 12/1941 | Miller | 34/99 |
| 2,339,159 | A | * | 1/1944 | Duncan et al. | 297/362 |
| 2,392,485 | A | * | 1/1946 | Langseth et al. | 34/90 |
| 2,703,134 | A | * | 3/1955 | Mossor | 297/180.14 |
| 2,738,593 | A | | 3/1956 | Fox et al. | |
| 2,769,247 | A | | 11/1956 | Krueger et al. | |
| 2,914,066 | A | * | 11/1959 | Gow | 601/166 |
| 3,058,231 | A | * | 10/1962 | Romito | 34/90 |
| 3,320,679 | A | * | 5/1967 | Collins | 34/99 |
| 3,691,646 | A | * | 9/1972 | Ruffolo | 34/90 |
| 3,786,575 | A | * | 1/1974 | Riblett | 34/99 |
| 3,863,651 | A | * | 2/1975 | Vaiano | 132/272 |
| 3,948,379 | A | | 4/1976 | Warner | |
| D247,379 | S | | 2/1978 | Hashino | |
| D287,436 | S | | 12/1986 | Diffrient | |
| 4,972,607 | A | * | 11/1990 | Lagace | 34/90 |
| D340,094 | S | * | 10/1993 | Houry et al. | D21/521 |
| 5,610,990 | A | * | 3/1997 | Wooderson et al. | 381/332 |
| D413,409 | S | * | 8/1999 | Williams | D28/19 |
| 6,243,207 | B1 | | 6/2001 | Kawamura et al. | |
| 7,353,620 | B1 | | 4/2008 | Houston | |
| 2002/0151830 | A1 | * | 10/2002 | Kahn | 601/155 |
| 2003/0139693 | A1 | * | 7/2003 | Swift | 601/15 |
| 2004/0127822 | A1 | * | 7/2004 | Eisenberg | 601/49 |
| 2005/0131273 | A1 | * | 6/2005 | Asano et al. | 600/27 |
| 2007/0101604 | A1 | * | 5/2007 | Brazier | 34/96 |
| 2007/0157376 | A1 | * | 7/2007 | Paz et al. | 4/540 |
| 2010/0301640 | A1 | * | 12/2010 | Heiser | 297/135 |

FOREIGN PATENT DOCUMENTS

| | | | |
|---|---|---|---|
| CN | 202552623 U | * | 11/2012 |
| KR | 20030083461 | * | 10/2003 |
| WO | WO 2014012197 | * | 1/2014 |

* cited by examiner

*Primary Examiner* — Steve M Gravini

(57) ABSTRACT

A hair drying system has a chair with a chair platform, a back rest, a first arm, and a second arm. A microprocessor with a data storage component is connected to an internet source. A massaging system with a plurality of vibrating components and a plurality of heating components is located in both the chair platform and the back rest. A hair dryer with a hair dryer mount is located on the back rest posterior surface. A monitor with a monitor positioning arm is pivotally located on a chair platform second edge. A tray is located on a tray positioning arm which is pivotally located on the monitor positioning arm. A remote control unit is removable and located in a recess located in a first arm armrest top surface.

5 Claims, 6 Drawing Sheets

HAIR DRYING SYSTEM

BACKGROUND OF THE INVENTION

Stationary hair dryers have been around since the late 1800s, originally taking their inspiration from vacuum cleaners. Often when a person uses a stationary hair dryer in a salon, they can become bored while their hair dries. Most often, this is a time when the person would read a newspaper or magazine for entertainment. The present invention features a hair drying system for drying hair on the user while the user watches television, listens to music, or uses a computer.

SUMMARY

The present invention features a hair drying system for drying hair on a user while the user watches television, listens to music, or uses a computer. In some embodiments, the system comprises a chair having a generally horizontal chair platform and a generally vertical back rest located at an angle on the chair platform. In some embodiments, the back rest bottom edge is located on the chair platform posterior edge.

In some embodiments, the chair comprises a first arm having a general shape of a "U" and a second arm having a general shape of a "U". In some embodiments, the chair comprises a plurality of legs located on the chair platform bottom surface.

In some embodiments, the system comprises a microprocessor having a data storage component. In some embodiments, the microprocessor is operatively connected to an internet source. In some embodiments, the system comprises a wireless Internet radio transmitter for providing wireless internet connectability. In some embodiments, the system comprises a power supply.

In some embodiments, the system comprises a massaging system. In some embodiments, the massaging system comprises a plurality of vibrating components and a plurality of heating components located in both the chair platform and the back rest.

In some embodiments, the system comprises a hair dryer. In some embodiments, the hair dryer comprises a hair dryer mount located on the back rest posterior surface. In some embodiments, a hair dryer bonnet is located on a hair dryer mount top end.

In some embodiments, the system comprises a monitor having a monitor positioning arm. In some embodiments, a monitor positioning arm first end is pivotally located on a chair platform second edge. In some embodiments, the monitor positioning arm pivots in a horizontal plane. Plane A, in an arc about 180 degrees.

In some embodiments, the system comprises a tray located on a tray positioning arm. In some embodiments, the tray positioning arm first end is pivotally located on the monitor positioning arm close to the monitor positioning arm second end. In some embodiments, the tray positioning arm second end is centrally located on a planar tray bottom surface. In some embodiments, the tray positioning arm pivots in a horizontal plane, Plane B, in an arc about 180 degrees.

In some embodiments, the system comprises a remote control unit. In some embodiments, the remote control unit communicates with the microprocessor. In some embodiments, the remote control unit is removably located in a recess located in a first arm armrest top surface. In some embodiments, the recess is adapted to secure and surround the remote control unit. In some embodiments, the remote control unit comprises function buttons on a remote control first side. In some embodiments, the remote control unit comprises a "QWERTY" keyboard located on a remote control second side. In some embodiments, the keyboard is adapted to input data into the microprocessor.

In some embodiments, the system comprises an arm control unit. In some embodiments, the arm control unit comprises a standard alternating current outlet located on the first arm armrest top surface. In some embodiments, the arm control unit comprises a universal serial bus (USB) port located on the first arm armrest top surface. In some embodiments, the arm control unit comprises a 3.5 millimeter audio jack located on the first am, armrest top surface.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
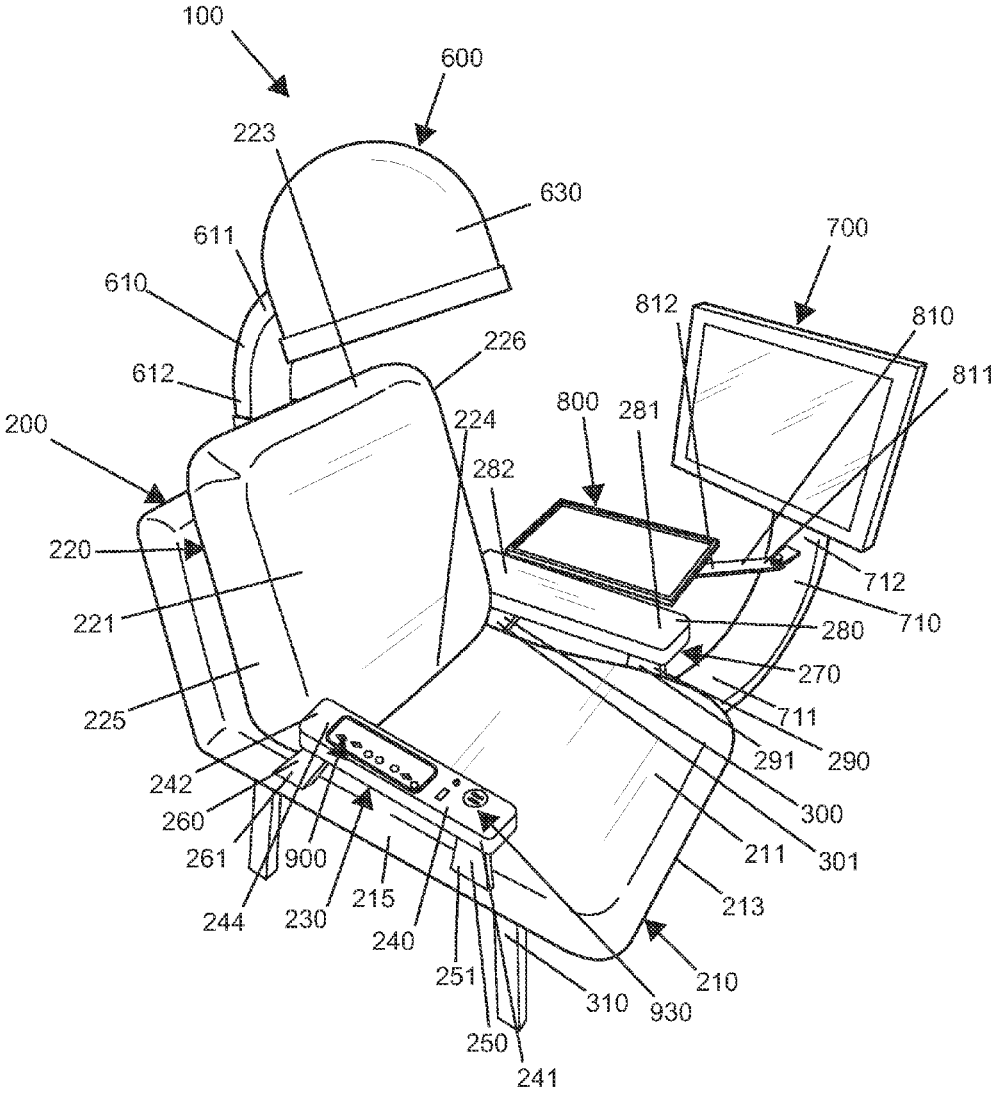
FIG. 1 is a perspective view of the present invention.

Following is a list of elements corresponding to a particular element referred to herein:

100 Hair drying system
200 Chair
210 Chair platform
211 Chair platform top surface
212 Chair platform bottom surface
213 Chair platform anterior edge
214 Chair platform posterior edge
3
215 Chair platform first edge
216 Chair platform second edge
220 Back rest
221 Back rest anterior surface
222 Sack rest posterior surface
223 Back rest top edge
224 Back rest bottom edge
225 Back rest first edge
226 Back rest second edge
230 First arm
240 First arm armrest
241 First arm armrest anterior end
242 First arm armrest posterior end
243 Recess
244 First arm armrest top surface
250 First arm anterior leg
251 First arm anterior leg free end
260 First arm posterior leg
261 First arm posterior leg free end
270 Second arm
280 Second arm armrest
281 Second arm armrest anterior end
282 Second arm armrest posterior end
290 Second arm anterior leg

Figure 2:
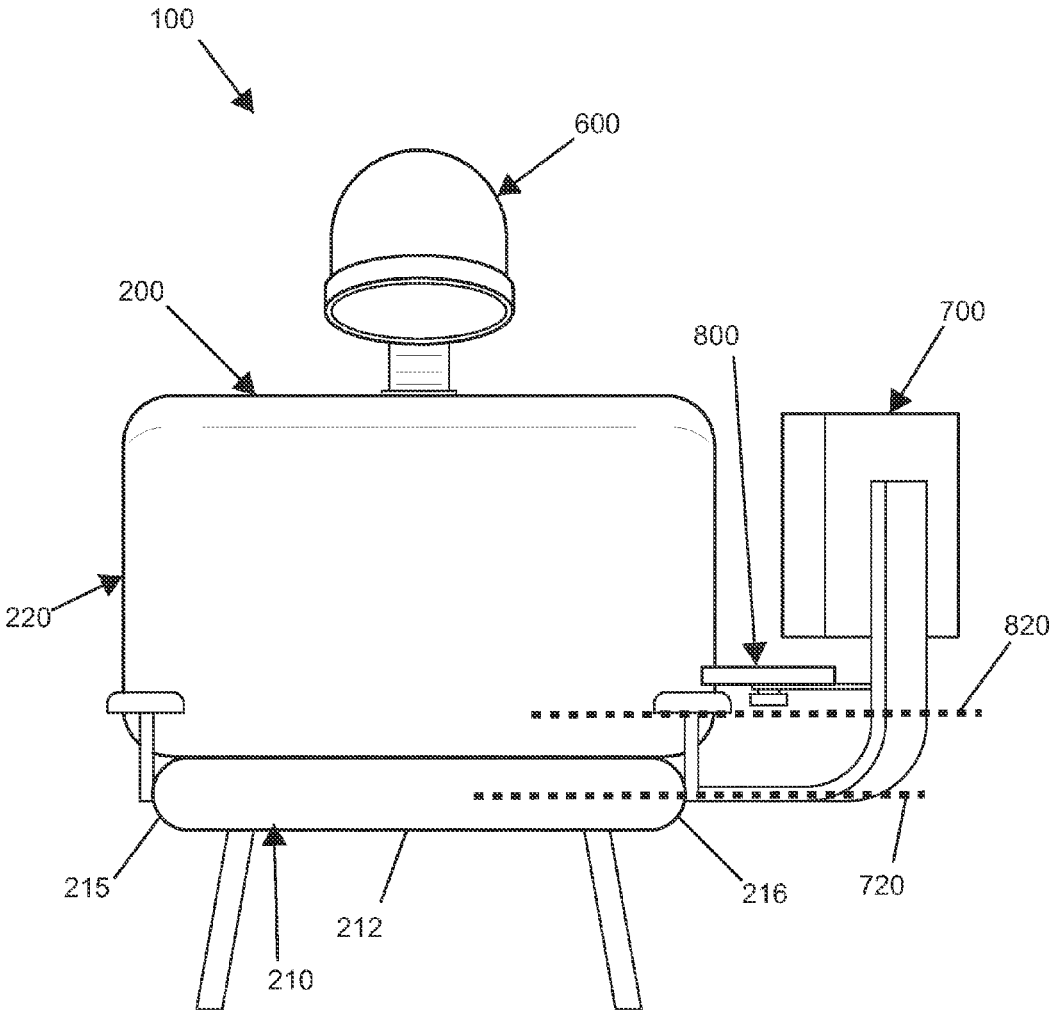
FIG. 2 is a front view of the present invention.
Figure 3:
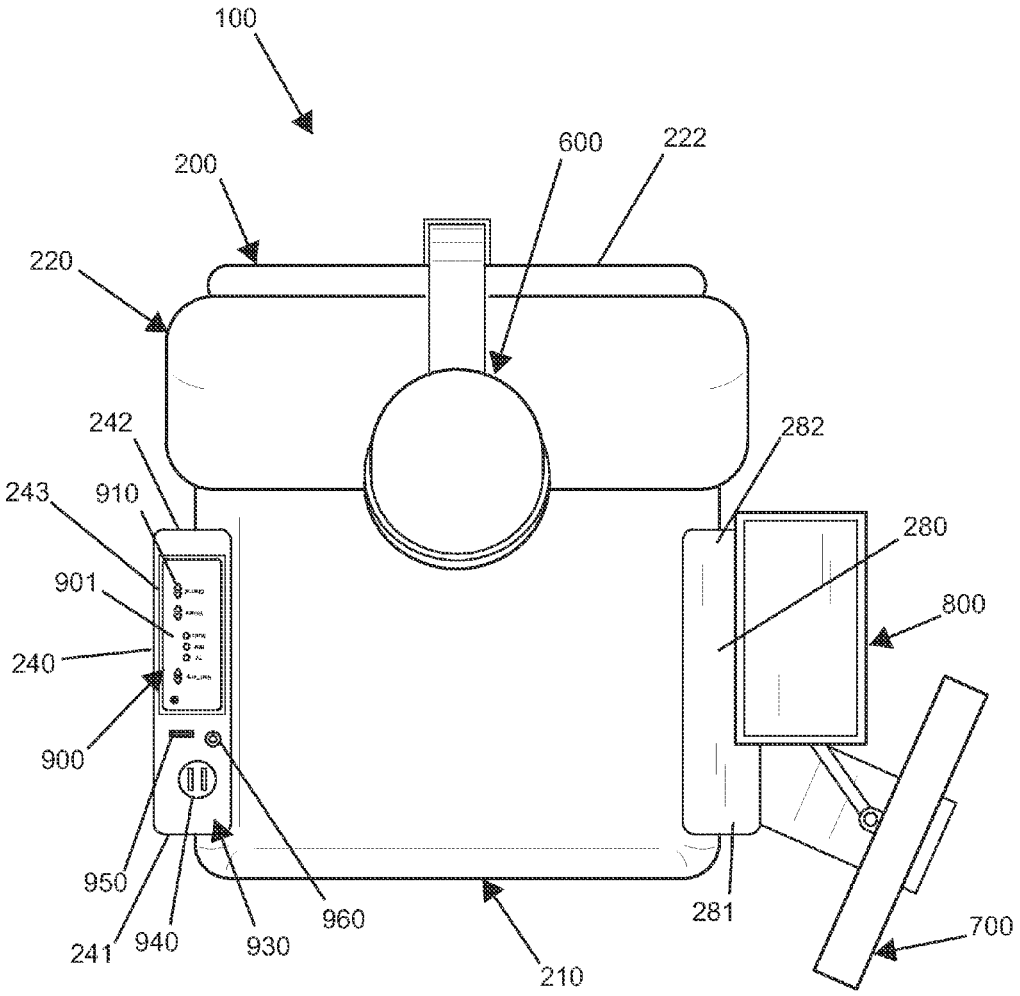
FIG. 3 is a top view of the present invention.
Figure 4:
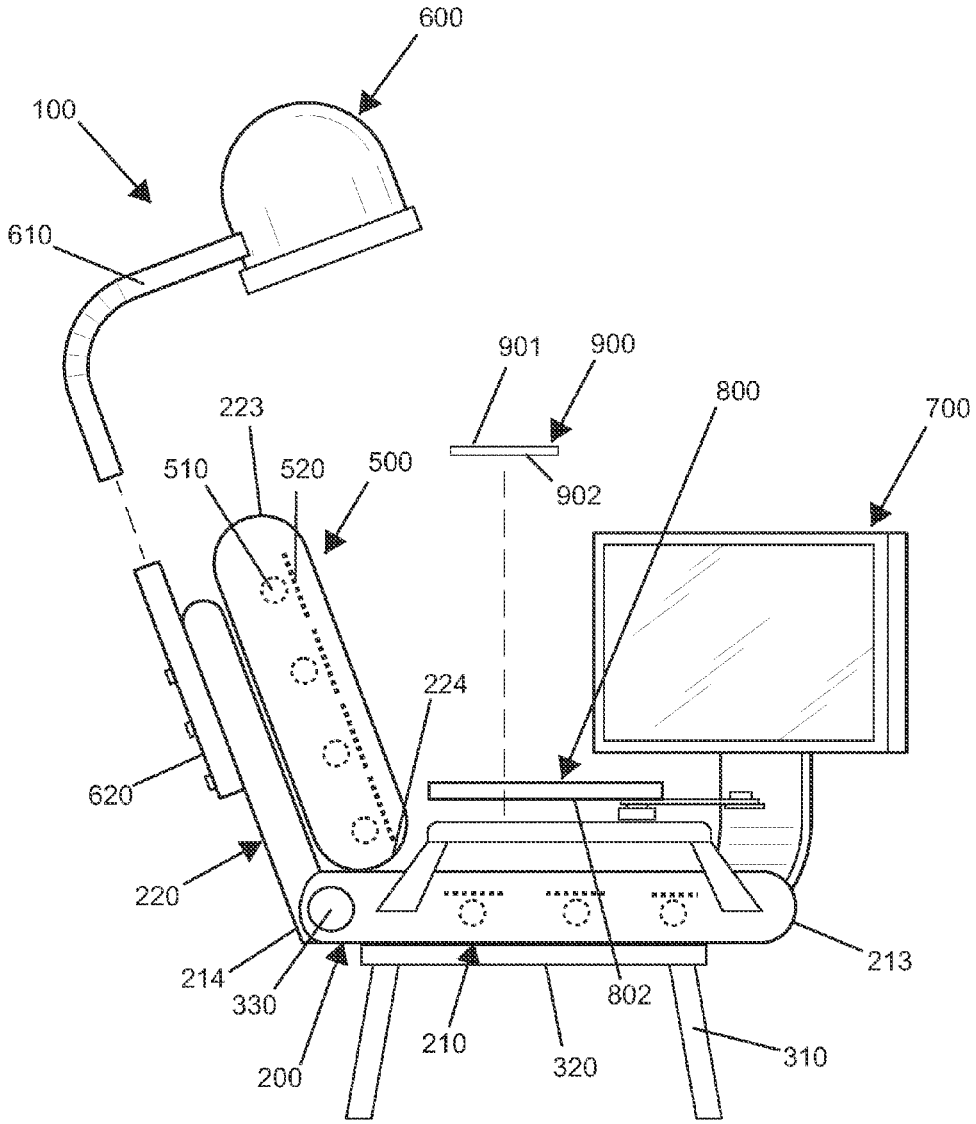
FIG. 4 is a side view of the present invention.
Figure 5:
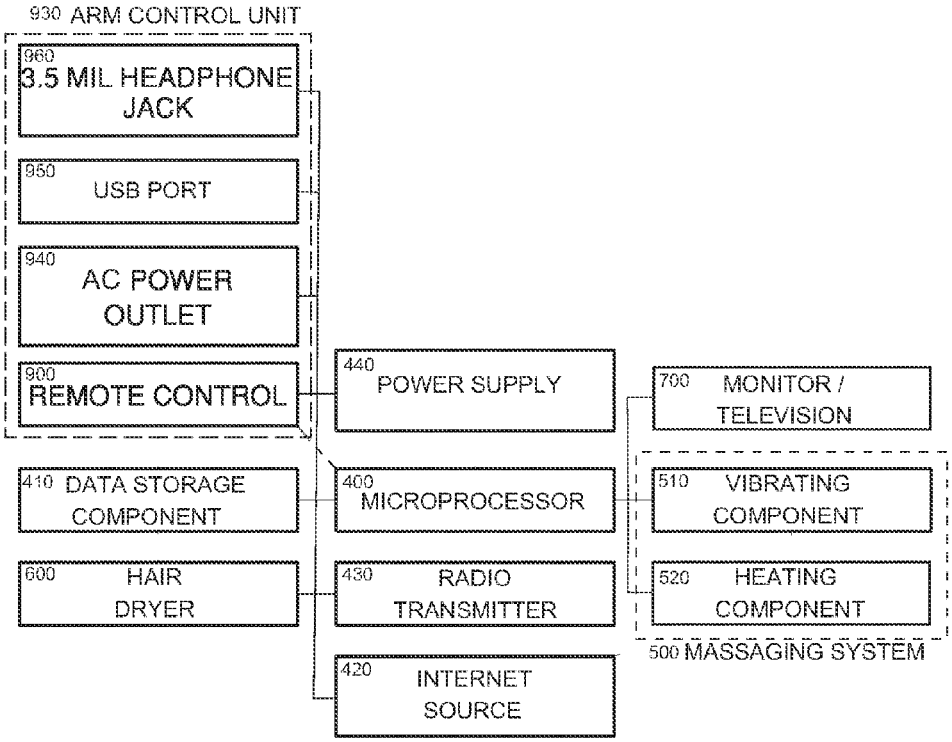
FIG. 5 is a schematic view of the present invention.
Figure 6:
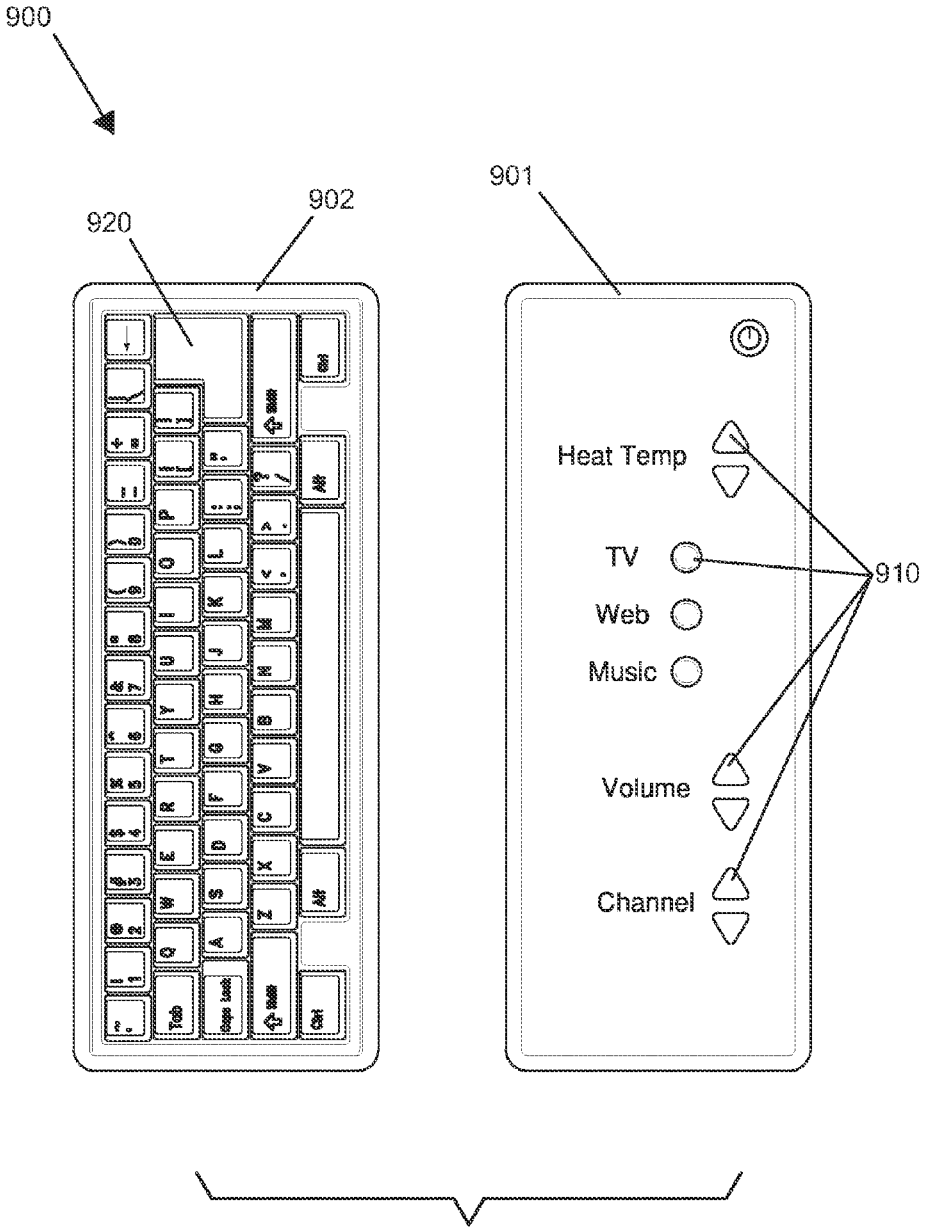
FIG. 6 is a view of the remote control first side and the remote control second side of the present invention.

291 Second arm anterior leg free end
300 Second arm posterior leg
301 Second arm posterior leg free end
310 Leg
320 Rotatable base
330 Redlining pivot
400 Microprocessor
410 Data storage component
420 Internet source
430 Wireless Internet radio transmitter
440 Power supply
500 Massaging system
210 Vibrating component
520 Heating component
600 Hair dryer
610 Hair dryer mount
611 Hair dryer mount top end
612 Hair dryer mount bottom end
620 Hair dryer sleeve
630 Hair dryer bonnet
700 Monitor
710 Monitor positioning arm
711 Monitor arm first end
712 Monitor arm second end
720 Plane A
800 Tray
802 Tray bottom surface
810 Tray positioning arm
811 Tray positioning arm first end
812 Tray positioning arm second end
820 Plane B
900 Remote control unit
901 Remote control first side
902 Remote control second side
910 Function button
920 "QWERTY" keyboard
930 Arm control unit
940 Alternating current outlet
950 Universal serial bus (USB) port
960 3.5 millimeter audio jack Referring now to FIG. 1-6, the present invention features a hair drying system (100) for drying hair on a user while the user watches television, listens to music, or uses a computer. In some embodiments, the system (100) comprises a chair (200) having a generally horizontal chair platform (210) and a back rest (220) located at an upright angle on the chair platform (210). In some embodiments, the angle is about 10 degrees from a vertical plane. In some embodiments, the angle is about 20 degrees from a vertical plane. In some embodiments, the angle is about 30 degrees from a vertical plane. In some embodiments, the chair platform (210) comprises a chair platform top surface (211), a chair platform bottom surface (212), a chair platform anterior edge (213), a chair platform posterior edge (214), a chair platform first edge (215), and a chair platform second edge (216). In some embodiments, the back rest (220) comprises a back rest anterior surface (221), a back rest posterior surface (222), a back rest top edge (223), a back rest bottom edge (224), a back rest first edge (225), and a back rest second edge (226). In some embodiments, the back rest bottom edge (224) is located on the chair platform posterior edge (214). In some embodiments, the chair platform (210) comprises a cushion located thereon. In some embodiments, the back rest (220) comprises a cushion located thereon.

In some embodiments, the chair (200) comprises a first arm (230) having a general shape of a "U" and a second arm (270) having a general shape of a "U". In some embodiments, the first arm (230) comprises a first arm armrest (240) having a first arm anterior leg (250) extending from a first arm armrest anterior end (241) and a first arm posterior leg (260) extending from a first arm armrest posterior end (242). In some embodiments, a first arm anterior leg free end (251) is located on a chair first edge (215) close to the chair platform anterior edge (213). In some embodiments, a first arm posterior leg free end (261) is located on a chair first edge (215) close to the chair platform posterior edge (214).

In some embodiments, the second arm (270) comprises a second arm armrest (280) having a second arm anterior leg (290) extending from a second arm armrest anterior end (281) and a second arm posterior leg (300) extending from a second arm armrest posterior end (282). In some embodiments, a second arm anterior leg free end (291) is located on a chair second edge (216) close to the chair platform anterior edge (213). In some embodiments, a second arm posterior leg free end (301) is located on a chair second edge (216) close to the chair platform posterior edge (214). In some embodiments, the chair (200) comprises a plurality of legs (310) located on the chair platform bottom surface (212). In some embodiments, the plurality of legs (310) extends out and away from the chair platform bottom surface (212).

In some embodiments, the system (100) comprises a microprocessor (400) having a data storage component (410) operatively connected thereto. In some embodiments, the microprocessor (400) is operatively connected to an Internet source (420). In some embodiments, the microprocessor (400) is operatively connected to a wireless internet radio transmitter (430) for providing wireless internet access to devices. In some embodiments, the system (100) comprises a power supply (440) operatively connected to the microprocessor (400). In some embodiments, the power supply (440) is alternating current electricity.

In some embodiments, the system (100) comprises a massaging system (500) operatively connected to the microprocessor (400). In some embodiments, the massaging system (500) comprises a plurality of vibrating components (510) and a plurality of heating components (520) located inside each of the chair platform (210) and the back rest (220). Vibrating components (510) and heating components (520) are well known to those of ordinary skill in the art. In some embodiments, the massaging system (500) is operatively connected to the power supply (440).

In some embodiment, the system (100) comprises a hair dryer (600) operatively connected to the microprocessor (400). In some embodiments, the hair dryer (600) comprises a hair dryer mount (610). In some embodiments, the hair dryer mount (610) comprises a hair dryer mount bottom end (612) located on the back rest posterior surface (222). In some embodiments, the hair dryer mount (610) extends out and away from the back rest top edge (223). In some embodiments, a hair dryer bonnet (630) is located on a hair dryer mount top end (611). In some embodiments, the hair dryer (600) is adapted to adjustably fit over the head of a user. In some embodiments the hair dryer (600) is operatively connected to the power supply (440). Hair dryers (600) are well known to those of ordinary skill in the art.

In some embodiments, the system comprises a monitor (700) having a monitor positioning arm (710). In some embodiments, the monitor positioning arm (710) comprises a monitor arm first end (711) and a monitor arm second end (712). In some embodiments, the monitor positioning arm (710) comprises a general shape of an "L". In some embodiments, the monitor arm first end (711) is pivotally located on a chair platform second edge (216). In some embodiments, the monitor positioning arm (710) pivots in a horizontal plane, Plane A (720), in an arc about 180 degrees. In some embodiments, the monitor arm second end (712) is located on the monitor (700). In some embodiments, the monitor (700) is operatively connected to the microprocessor (400). In some embodiments, the monitor (700) is adapted to be used as a computer monitor when using the microprocessor (400) as a personal computer. In some embodiments, the monitor (700) is adapted to be used as a television. In some embodiments, the monitor (700) is operatively connected to the power supply (440). Televisions are well known to those of ordinary skill in the art. Monitors and personal computers are well known to those of ordinary skill in the art.

In some embodiments, the system (100) comprises a tray (800) located on a tray positioning arm (810). In some embodiments, the tray positioning arm (810) comprises a tray positioning arm first end (811) and a tray positioning arm second end (812). In some embodiments, the tray positioning arm (810) is generally linear. In some embodiments, the tray positioning arm first end (811) is pivotally located on the monitor positioning arm (710) close to the monitor positioning arm second end. In some embodiments, the tray positioning arm second end (812) is centrally (and pivotally) located on a planar tray bottom surface (802). In some embodiments, the tray positioning arm (810) pivots in a horizontal plane, Plane B (820), in an arc about 180 degrees.

In some embodiments, the system (100) comprises a remote control unit (900). In some embodiments, the remote control unit (900) comprises a compact power source operatively connected to and disposed within. In some embodiments, the remote control unit (900) communicates with the microprocessor (400) via radio signal. In some embodiments, the remote control unit (900) is removably located in a recess (243). In some embodiments, the recess (243) is located in a first arm armrest top surface (244). In some embodiments, the recess (243) is adapted to secure and surround the remote control unit (900) on all sides except the top (upward facing side). In some embodiments, the remote control unit (900) comprises function buttons (910) on a remote control first side (901). In some embodiments, the function buttons (910) comprise control buttons for the monitor (700) and the microprocessor (400) (computer and television functions), the massaging system (500), and the hair dryer (600). In some embodiments, the function buttons (910) comprise a power button, temperature up and temperature down buttons for the massaging system (500), selector buttons for television, computer (Internet browsing), or audio functions, volume up and volume down buttons for the television, computer (Internet browsing), or audio functions, and channel up and channel down buttons for the television. In some embodiments, the remote control unit (900) comprises a "QWERTY" keyboard (920) located on a remote control second side (902). In some embodiments, the keyboard (920) is adapted to input data into the microprocessor (400). Remote controls are well known to those of ordinary skill in the art.

In some embodiments, the system (100) comprises an arm control unit (930). In some embodiments, the arm control unit (930) comprises a standard alternating current outlet (940) located on the first arm armrest top surface (244). In some embodiments, the alternating current outlet (940) is operatively connected to the power supply (440). In some embodiments, the arm control unit (930) comprises a universal serial bus (USB) port (950) located on the first arm armrest top surface (244). In some embodiments, the universal serial bus port (950) is operatively connected to the microprocessor (400). In some embodiments, the arm control unit (930) comprises a 3.5 millimeter audio jack (960) located on the first arm armrest top surface (244). In some embodiments, the audio jack (960) is operatively connected to the microprocessor (400). In some embodiments, the arm control unit (930) comprises additional control buttons operatively connected to (for controlling) the monitor (700) and the microprocessor (400) (computer and television functions), the massaging system (500), and the hair dryer (600).

In some embodiments, the "QWERTY" keyboard (920) is a touchscreen.

In some embodiments, the chair (200) is rotatable. In some embodiments, the chair platform bottom surface (212) comprises a rotatable base (320). In some embodiments, the rotatable base (320) is lockable.

In some embodiments, the chair (200) comprises a reclining pivot (330). In some embodiments, a generally vertical back rest (220) is pivotally located at an adjustable angle on the chair platform (210). In some embodiments, the reclining pivot (330) is lockable.

In some embodiments, the hair dryer (600) is detachable and reattachable. In some embodiments, the hair dryer mount (610) is slidably located in a hair dryer sleeve (620) and adjustable for different heights. In some embodiments, the hair dryer sleeve (620) is located on the back rest posterior surface (222) close to the back rest top edge (223).

As used herein, the term "about" refers to plus or minus 10% of the referenced number. For example, an embodiment wherein the tray is about 10 inches in length includes a tray that is between 9 and 11 Inches in length.

The disclosures of the following U.S. Patents are incorporated in their entirety by reference herein: U.S. Pat. No. D 287,436; U.S. Pat. No. D 247,379; U.S. Pat. No. 7,353,620; U.S. Pat. No. 6,243,207; U.S. Pat. No. 3,948,379; U.S. Pat. No. 2,769,247; and U.S. Pat. No. 2,738,693.

Various modifications of the invention, in addition to those described herein, will be apparent to those skilled in the art from the foregoing description. Such modifications are also intended to fan within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A hair drying system (100) for drying hair on a user while the user watches television, listens to music or uses a computer, wherein said system (100) comprises:

(a) a chair (200) having a generally horizontal chair platform (210) and a generally vertical back rest (220) disposed at an upright angle on the chair platform (210), wherein the chair platform (210) comprises a chair platform top surface (211), a chair platform bottom surface (212), a chair platform anterior edge (213), a chair platform posterior edge (214), a chair platform first edge (215), and a chair platform second edge (216), wherein the back rest (220) comprises a back rest anterior surface (221), a back rest posterior surface (222), a back rest top edge (223), a back rest bottom edge (224), a back rest first edge (225), and a back rest second edge (226), wherein the back rest bottom edge (224) is disposed on the chair platform posterior edge (214), wherein the chair (200) comprises a first arm (230) having a general shape of a "U" and a second arm (270) having a general shape of a "U", wherein the first arm (230) comprises a first arm armrest (240) having a first arm anterior leg (250) extending from a first arm armrest anterior end (241) and a first arm posterior leg (260) extending from a first arm armrest posterior end (242), wherein a first arm anterior leg free end (251) is disposed on a chair first edge (215) proximal to the chair platform anterior edge (213), wherein a first arm posterior leg free end (261) is disposed on a chair first edge (215) proximal to the chair platform posterior edge (214), wherein the second arm (270) comprises a second arm armrest (280) having a second arm anterior leg (290) extending from a second arm armrest anterior end (281) and a second arm posterior leg (300) extending from a second arm armrest posterior end (282), wherein a second arm anterior leg free end (291) is disposed on a chair second edge (216) proximal to the chair platform anterior edge (213), wherein a second arm posterior leg free end (301) is disposed on a chair second edge (216) proximal to the chair platform posterior edge (214), wherein the chair (200) comprises a plurality of legs (310) disposed on the chair platform bottom surface (212), wherein the plurality of legs (310) extends out and away from the chair platform bottom surface (212);

(b) a microprocessor (400) having a data storage component (410) operatively connected thereto, wherein the microprocessor (400) is operatively connected to an internet source (420), wherein the microprocessor (400) is operatively connected to a wireless internet radio transmitter (430);

(c) a power supply (440) operatively connected to the microprocessor (400);

(d) a massaging system (500) operatively connected to the microprocessor (400), wherein the massaging system (500) comprises a plurality of vibrating components (510) and a plurality of heating components (520) disposed inside the chair platform (210) and the back rest (220);

(e) a hair dryer (600) operatively connected to the microprocessor (400), wherein the hair dryer (600) comprises a hair dryer mount (610), wherein the hair dryer mount (610) comprises a hair dryer mount bottom end (612) disposed on the back rest posterior surface (222), wherein the hair dryer mount (610) extends out and away from the back rest top edge (223), wherein a hair dryer bonnet (630) is disposed on a hair dryer mount top end (611);

(f) a monitor (700) having a monitor positioning arm (710), wherein the monitor positioning arm (710) comprises a monitor arm first end (711) and a monitor arm second end (712), wherein the monitor positioning arm (710) comprises a general shape of an "L", wherein the monitor arm first end (711) is pivotally disposed on a chair platform second edge (216), wherein the monitor positioning arm (710) pivots in a horizontal plane, Plane A (720), in an arc about 180 degrees, wherein the monitor arm second end (712) is disposed on the monitor (700);

(g) a tray (800) disposed on a tray positioning arm (810), wherein the tray positioning arm (810) comprises a tray positioning arm first end (811) and a tray positioning arm second end (812), wherein the tray positioning arm (810) is generally linear, wherein the tray positioning arm first end (811) is pivotally disposed on the monitor positioning arm (710) proximal to the monitor positioning arm second end, wherein the tray positioning arm second end (812) is centrally disposed on a planar tray bottom surface (802), wherein the tray positioning arm (810) pivots in a horizontal plane, Plane B (820), in an arc about 180 degrees;

(h) a remote control unit (900), wherein the remote control unit (900) communicates with the microprocessor (400) via radio signal, wherein the remote control unit (900) is removably disposed in a recess (243), wherein the recess (243) is disposed in a first arm armrest top surface (244), wherein the recess (243) is adapted to secure and surround the remote control unit (900), wherein the remote control unit (900) comprises function buttons (910) on a remote control first side (901), wherein the function buttons (910) comprise control buttons for the monitor (700) and the microprocessor (400) (computer and television functions), the massaging system (500), and the hair dryer (600), wherein the function buttons (910) comprise a power button, temperature up and temperature down buttons for the massaging system (500), selector buttons for television, computer (internet browsing), or audio functions, volume up and volume down buttons for the television, computer (internet browsing), or audio functions, and channel up and channel down buttons for the television, wherein the remote control unit (900) comprises a "QWERTY" keyboard (920) disposed on a remote control second side (902), wherein the keyboard (920) is adapted to input data into the microprocessor (400); and (i) an arm control unit (930), wherein the arm control unit (930) comprises a standard alternating current outlet (940) disposed on the first arm armrest top surface (244), wherein the alternating current outlet (940) is operatively connected to the power supply (440), wherein the arm control unit (930) comprises a universal serial bus (USB) port (950) disposed on the first arm armrest top surface (244), wherein the universal serial bus port (950) is operatively connected to the microprocessor (400), wherein the arm control unit (930) comprises a 3.5 millimeter audio jack (960) disposed on the first arm armrest top surface (244), wherein the audio jack (960) is operatively connected to the microprocessor (400).

2. The system (100) of claim 1, wherein the "QWERTY" keyboard (920) is a touchscreen.

3. The system (100) of claim 1, wherein the chair (200) is rotatable, wherein the chair platform bottom surface (212) comprises a rotatable base (320).

4. The system (100) of claim 1, wherein the chair (200) comprises a reclining pivot (330), wherein a generally vertical back rest (220) is pivotally disposed at an adjustable angle on the chair platform (210).

5. The system (100) of claim 1, wherein the hair dryer (600) is detachable and reattachable, wherein the hair dryer mount (610) is disposed in a hair dryer sleeve (620), wherein the hair dryer sleeve (620) is disposed on the back rest posterior surface (222) proximal to the back rest top edge (223).

* * * * *